US005247149A

United States Patent [19]

Peleg

[11] Patent Number: 5,247,149

[45] Date of Patent: Sep. 21, 1993

[54] METHOD AND APPLIANCE FOR COOKING A FROZEN PIZZA PIE WITH MICROWAVE ENERGY

[75] Inventor: Yigal Peleg, Solon, Ohio

[73] Assignee: The Stouffer Corporation, Solon, Ohio

[21] Appl. No.: 751,129

[22] Filed: Aug. 28, 1991

[51] Int. Cl.[5] ..... H05B 6/80

[52] U.S. Cl. ..... 219/10.55 E; 219/10.55 F; 219/10.55 M; 426/107; 426/113; 426/234; 426/243; 99/DIG. 14

[58] Field of Search ..... 219/10.55 E, 10.55 F, 219/10.55 M; 426/107, 113, 243, 234; 99/DIG. 14; 206/497, 821

[56] References Cited

U.S. PATENT DOCUMENTS

| | | | |
|---|---|---|---|
| 4,190,757 | 2/1980 | Turpin et al. | 219/10.55 E |
| 4,230,924 | 10/1980 | Bradstad | 219/10.55 E |
| 4,248,901 | 2/1981 | Austin | 206/821 |
| 4,267,420 | 5/1981 | Bradstad | 219/10.55 E |
| 4,361,227 | 11/1982 | Paulucci | 206/497 |
| 4,411,364 | 10/1983 | Friedman | 206/497 |
| 4,453,665 | 6/1984 | Roccarforte et al. | 426/107 |
| 4,594,492 | 6/1986 | Maroszek | 219/10.55 E |
| 4,626,641 | 12/1986 | Brown | 219/10.55 E |
| 4,641,005 | 2/1987 | Seiferth | 219/10.55 E |
| 4,656,325 | 4/1987 | Keefer | 219/10.55 E |
| 4,705,929 | 11/1987 | Atkinson | 219/10.55 E |
| 4,815,602 | 3/1989 | Schirmer | 206/497 |
| 4,841,112 | 6/1989 | Peleg | 219/10.55 E |
| 4,891,482 | 1/1990 | Jaeger et al. | 219/10.55 E |
| 4,940,867 | 6/1990 | Peleg | 219/10.55 E |
| 5,126,519 | 6/1992 | Peleg | 219/10.55 E |

*Primary Examiner*—Bruce A. Reynolds
*Assistant Examiner*—Tu Hoang
*Attorney, Agent, or Firm*—Body, Vickers & Daniels

[57] ABSTRACT

A combination of a frozen pizza of uncooked dough covered with a topping layer except for an outer sauce-free ring of dough and a microwave susceptor component enables the pizza to be cooked in a microwave oven so that the outer ring is brown and crisp. The microwave susceptor component can include one element which is either directly on or supported above the dough. The susceptor component also includes a susceptor sheet on which the pizza rests.

29 Claims, 7 Drawing Sheets

FIG. 8
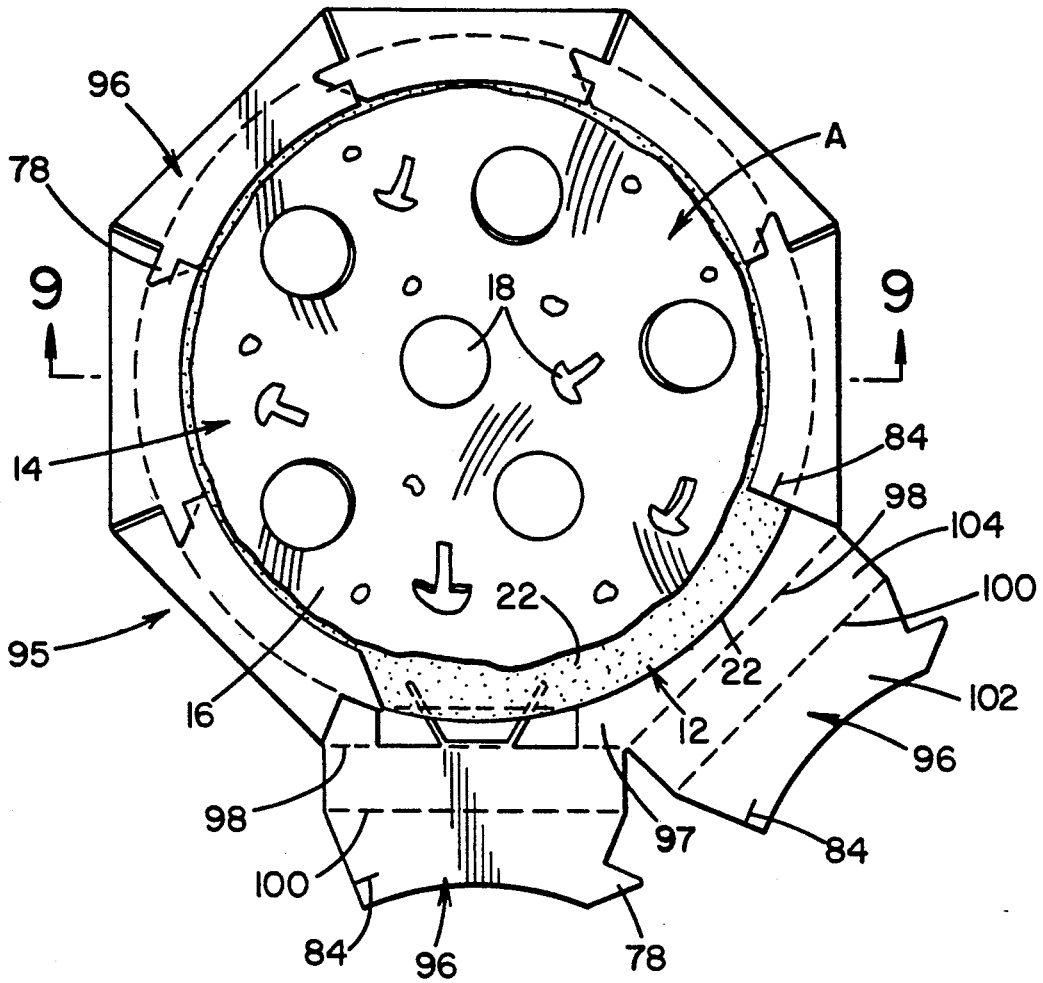
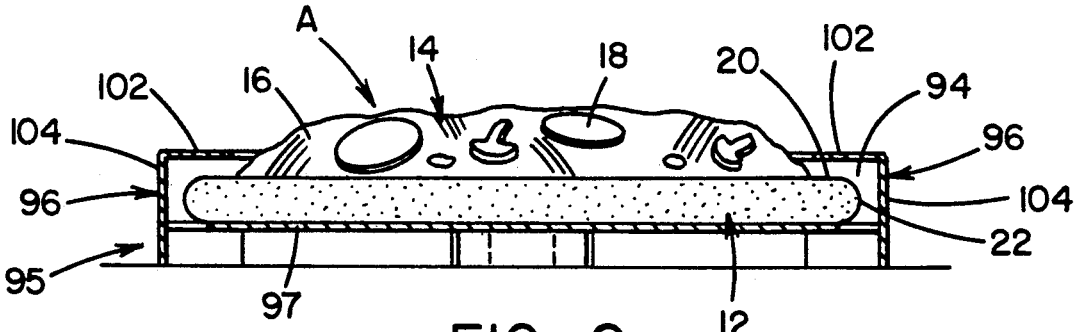
FIG. 9

FIG. 10
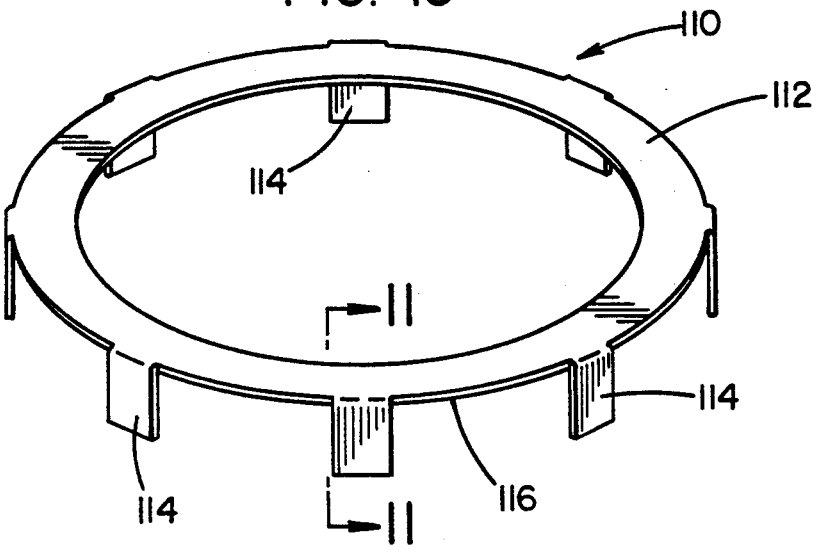
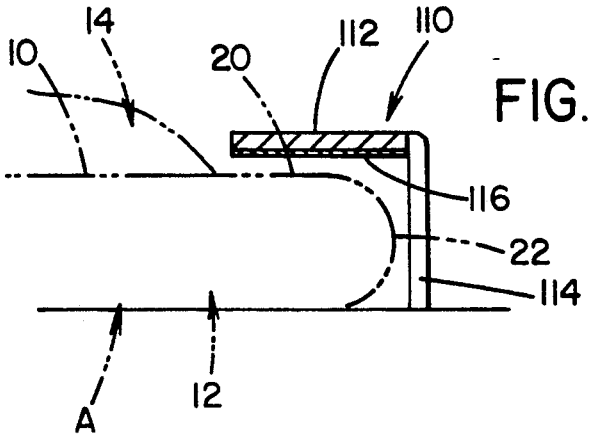
FIG. 11
FIG. 12
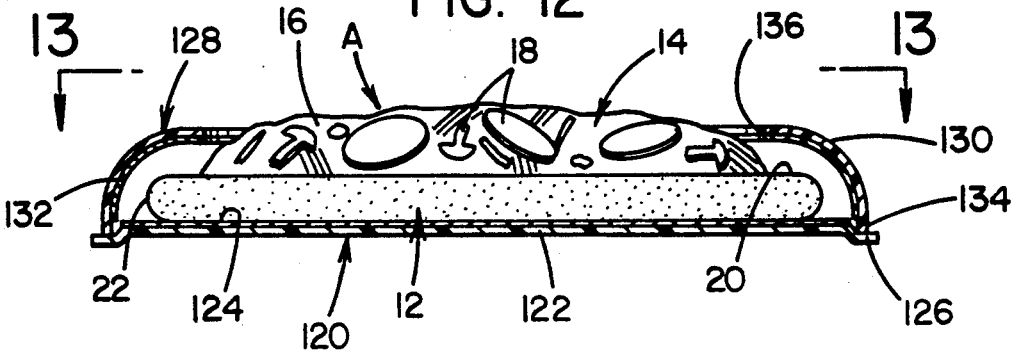

METHOD AND APPLIANCE FOR COOKING A FROZEN PIZZA PIE WITH MICROWAVE ENERGY

This invention relates to the art of reconstituting a frozen food entree, such as a frozen pizza pie, by using microwave energy and more particularly to a combination of the entree, or pizza pie, and the appliance or container in which it is transported and reconstituted.

INCORPORATION BY REFERENCE

For the purpose of background information, the following U.S. patents are incorporated by reference herein. Turpin U.S. Pat. No. 4,190,757; Brastad U.S. Pat. Nos. 4,230,924 and 4,267,420; Maroszek U.S. Pat. No. 4,594,492; Brown U.S. Pat. No. 4,626,641; Seiferth U.S. Pat. No. 4,641,005; Keefer U.S. Pat. No. 4,656,325; Peleg U.S. Pat. No. 4,841,112; and Jaeger et al. U.S. Pat. No. 4,891,482. These patents relate to prior art concepts for incorporating special sheet material with a foodstuff cooked in a microwave oven to assist in the cooking of refrigerated and/or frozen foodstuffs. These patents constitute a portion of the patented prior art for background of the present invention so that details known in the art need not be repeated to understand the present invention and its novelty.

BACKGROUND OF THE INVENTION

The present is directed to a novel combination of an appliance with a frozen dough that is topped by sauce to allow the dough which must be heated and browned to be browned by a microwave while cooking the sauce. Heretofore this major problem has been unsolved so that pizza pies have not generally been available in a frozen condition and yet capable of being reconstituted in a microwave oven to produce an appetizing end result. For that reason, pizza pies from quality producers have been packaged and sold without a cooking pan for placement on a metal pan which is to be placed into a conventional convection oven. Only in this way was it possible to obtain the desired appearance and taste. However, convection cooking requires a substantially long heating time to reconstitute the frozen pizza pie into an acceptable food entree. With the advent of microwave cooking of frozen foodstuffs and general availability of such ovens, microwave cooking has become overwhelmingly demanded by the consuming public. Consequently, manufacturers of quality pizza pies and other crusted food items, or foodstuff, have been seeking an acceptable vehicle for manufacturing frozen pizza pies, transporting them in an inexpensive carton for display at a retail outlet and then for reconstitution by a microwave oven in a cooking time drastically less than the time required for baking the pizza pie in a conventional convection oven.

So far, these efforts to produce a microwave, heatable pizza pie in an inexpensive transporting arrangement have generally eluded the manufacturers of pizza pies. As an attempt to overcome this problem, some pies have been prebaked so that the crust is browned and then sold in a plastic container which can be heated in a microwave oven. This is nothing more than warming or reheating a previously cooked pie and does not solve the problem and produce the end result of an uncooked pie being baked and browned by a microwave oven. In addition, prebaking or partial baking of the pizza pie tends to cause separation of the sauce from the crust during shipment and/or reconstitution. Some pies have substances placed on the crust to bring the crust to the desire cooked appearance.

The various patents incorporated by reference herein illustrate the extent to which major manufacturers are attempting to utilize microwave ovens for reconstituting foodstuffs of various types which involve browning and other localized heating. None of these prior art patents, incorporated for background information, teach the novel combination of a pizza pie and appliance in accordance with the present invention; however, certain aspects of these patents are relevant to the background of the invention and these various aspects will be described briefly to illustrate the futility of prior patented concepts in solving the basic problem to which the present invention is directed. This apparent futility is carried over into the marketplace where the problem of cooking pizza pies has not been solved.

Turpin U.S. Pat. No. 4,190,757 relates to an early effort to develop a carton for a pizza pie having a cover with an inside surface which acts to shield the pizza from the transmission of microwave energy. Openings of a predetermined size in the cover enable transmission of the microwaves to heat the pizza while venting a vapor or steam biproduct. The pizza pie sits on an aluminum foil layer of a flexible or semi-flexible heating body which absorbs microwaves and will apparently transmit heat to the pizza pie by conduction through the aluminum layer to crisp or brown the bottom of the pizza pie. This construction is defective because it does not brown or crisp the outer edge surface of the pizza pie which does not contain sauce.

Brown U.S. Pat. No. 4,567,341 relates to a microwave carton which is particularly suitable for pizza pie. Venting of vapors generated within the carton during the heating is provided. However, there is no provision of a means to brown or crisp the outer edges of the pizza pie.

Maroszek U.S. Pat. No. 4,661,671 discloses a carton for a pizza pie including an interactive heater material for directing heat into the bottom surface of the pizza pie. This patent does not overcome the problem of the failure to selectively brown or crisp the edges of the dough.

Peleg U.S. Pat. No. 4,841,112 relates to the placement of a stiff susceptor on the upper surface of dough covering a pot pie in a microwave impervious receptacle. There is no suggestion of cooking a pizza pie with susceptors to brown and/or crisp the outer edge of the dough which is free of sauce.

Jaeger U.S. Pat. No. 4,891,482 relates to a sleeve surrounding the lower portion of a food product, such as a pizza, whereby the upper layer is cooked by radiant and microwave heating while the lower crust layer is heated primarily by high temperature conduction.

SUMMARY OF THE INVENTION

The present invention provides a heretofore unavailable appliance to reconstitute pizza pies and other frozen foodstuffs having a bottom crusted surface and an upper surface partially covered with sauce and partially browned and crisped. This invention accomplishes this objective without adopting the teachings or suggestions of the various prior art patents disclosing bits and pieces of technology attempting to solve a variety of microwave cooking problems with various foods where some teachings are related to the objective of the present invention and some teachings are completely irrelevant to the objective of the present invention.

In accordance with the invention, there is provided a combination of a mass produced frozen foodstuff, such as a pizza pie, formed from a layer of uncooked dough with a preselected thickness and covered with a topping layer, except for an outer ring of dough free of sauce of a preselected size extending inwardly from the outer peripheral edge of the layer of dough and an appliance for transporting and reconstituting this foodstuff in a microwave oven. The appliance of this combination includes, as a first component, a tray-like receptacle formed of a rigid microwave susceptor sheet for supporting the layer of dough; and as a second component, a microwave susceptor ring having a shape generally matching the preselected size of the ring of dough and being supported directly on the ring of dough. The first and second components are heated when subjected to microwave energy and bake the dough to form a crisp crust on the bottom surface of the dough and a browned, crisp crust on the top surface of the ring of dough. By providing the oppositely facing microwave susceptors, the ring of dough therebetween is completely and evenly baked in a short amount of time, as compared to a single susceptor under the pie. This is a significant advantage in reconstituting pizza pies because rapid baking of the dough prevents it from having a rubbery constitution. Also, the speed in cooking in combination with the concentration of heat around the edges of the pizza prevents vapor generated by heating the layer of sauce from collecting at the area under the upper susceptor ring and thereby causing the dough to be soggy.

In one embodiment, the susceptor ring, used in combination with the frozen pizza and the susceptor sheet which supports the pizza, is a self-sustaining, generally rigid, microwave susceptor with an outer shape generally matching the preselected shape of the dough, free of sauce, which extends inwardly from the outer peripheral edge of the dough. Generally, the susceptor ring does not extend significantly beyond the lateral edge of the dough. However, it is beneficial to at least cover the ring of dough which is being cooked to form a crust and prevent any moisture from collecting thereon.

The susceptor sheet is constructed of a thin, metallized layer on a plastic film laminated to a relatively rigid paperboard. Typically, the thickness of the complete susceptor sheet is less than about 0.2 cm and the metallized layer has a thickness allowing microwave heating of the thin metal layer to cook the dough into a crisp crust by convection heating at a temperature generally exceeding about 400° F. The sauce is simultaneously heated by microwave energy passing through the dough covered by the sauce as well as from microwave energy emitted directly from the oven.

The susceptor sheet which supports the frozen pizza pie is generally slightly larger than the pizza pie in order that the entire bottom surface of the dough in contact with the susceptor sheet is browned into a crust by convection heating primarily generated by microwave energy directed through the susceptor sheet. This susceptor sheet is constructed of the same material as the susceptor ring described before. However, the specific construction details as to the thickness do not make up a part of the present invention and any operable thickness for the susceptor ring or the susceptor sheet can be used.

The combination of the frozen pizza on the susceptor sheet and a susceptor ring which is self-sustainable and positioned directly over the dough being heated provides a total appliance which can be shipped in a carton and used to reconstitute a pizza pie by a customer using a microwave oven. The carton itself is discarded after the pizza pie and the susceptors have been removed. Consequently, the extremely disadvantageous concept of heating a pizza pie in a carton is avoided. Blind heating of a pizza pie in a carton which hides the pizza pie from view of the customer is definitely disadvantageous in the frozen food market; consequently, the present invention provides an arrangement for cooking a pizza pie from the frozen condition to the baked, browned condition by a microwave without employing some type of special carton, wrapper or tube into which the pie must be inserted. By the novel concept of employing a susceptor sheet for supporting the pizza pie and an upper susceptor ring lying on the portion of the upper surface of the dough near the sauce-free edges, the pizza pie can be reconstituted by a microwave oven so that the outer edge of the dough becomes crisp and browned in full view of the person reconstituting the product. The browning effect of the susceptor ring lying directly on the surface of the dough causes desirable browning of the dough into a quality, crisp crust. This is a distinct advantage not realized by items on the market before the present invention or described in the prior art patents incorporated by reference herein. By marketing pizza pie with the novel two component appliance of the present invention, the consumer has options heretofore unavailable in reconstituting frozen pizza pies and similar food products.

In accordance with a second embodiment of the invention, the tray-like receptacle which supports the pizza pie includes a corrugated paper layer laminated to the susceptor sheet for supporting the pizza pie above the bottom wall of the microwave oven. By separating the pizza pie away from an inner surface of the microwave oven, more microwave energy is directed through the pizza pie so as to reduce the time required to complete its cooking and reconstitution. The inclusion of means, such as the corrugated paper layer, being laminated onto the tray-like receptacle is a novel aspect which can be adapted for each of the various, novel, component appliances described herein.

In accordance with a third embodiment of the present invention, the tray-like receptacle forming a rigid microwave susceptor sheet is substantially octagonal and includes heat tab elements disposed in hinged relationship to each edge of the sheet. Each of the heat tab elements are hinged along score lines and disposed at an acute angle to overlie the sheet during the microwave cooking of the pizza. The space between the hinged, upstanding heat tab elements and the flat sheet receives the sauce free, outer ring of the pizza pie.

The pizza pies cooked with this device are preferably circular and have a substantially circular, sauce free ring of dough extending around the perimeter of the upper surface of pies. When the heat tab elements are in position they overlie this sauce-free, ring of dough. By heating a pizza pie placed on this tray-like receptacle, the ring of dough is cooked to a browned, crisp crust. Simultaneously, the remainder of the dough is cooked into a crust while the sauce is heated. Accordingly, the third embodiment is able to accomplish a previously unattainable manufacturing goal, to provide a frozen pizza for consumer consumption which can be reconstituted in a microwave oven so that the edges and uncovered top surface of the dough are browned and crisped to form a high quality crust. As with the first embodiment, the concentration of heat around the edge of the dough and the covering of the edge with the heat tab elements provides rapid cooking while preventing the collection of vapor and the resulting sogginess of the dough. This advantage, which has tremendous financial implications, is further enhanced because the tray-like device is formed of a novel, integral one piece structure with score lines where the projecting heat tabs are hingedly attached. Besides the economics of packaging a pizza pie on a one piece tray, the consumer can easily and rapidly bend the flaps into position after it has been removed from the box. Alternatively, the heat tabs can be in position, overlying the sauce free ring on the top surface of the dough, while it is within the package. While an octagonally shaped tray is disclosed, it is within the terms of the invention to form the tray with any desired shape to accommodate any shaped pizza such as rectangular.

In accordance with the invention, a fourth embodiment provides the frozen pizza pie is packaged on a substantially octagonal tray-like receptacle including a rigid microwave susceptor sheet. A circular fold line, provided on the susceptor sheet, forms the bottom edge of a plurality of heat tab elements which, in operation, are folded at an acute angle to overlie the portion of the susceptor sheet circumscribed by the fold line. This enables the heat tab elements to be bent or folded into position so as to overlie the susceptor sheet and form a high intensity, heating section where the microwave energy passing through the susceptor bakes the dough within the heating section into a browned, crispy crust. As with the previous embodiment, the heat tab elements are preferably positioned by the consumer after removing the pizza pie and its support tray from a box. However, it is within the scope of the invention to position the heat tabs prior to closing the packaging box. To ensure that the heat tabs maintain the desired upright and angularly disposed position with respect to the susceptor sheet, structure can be provided for locking adjacent heat tabs to each other. For example, a closing tab projecting from each heat tab can be received in a slit formed in an adjacent tab. By locking the adjacent tabs to each other, the inclination of the tabs to the sheet can be preset so as to maximize the heating effect on the peripheral edge surface of the pizza between the tab and the sheet.

In accordance with the invention, a fifth embodiment of the invention relates to a frozen pizza pie packaged on a substantially circular, tray-like receptacle incorporating a rigid microwave susceptor sheet. A dome-like susceptor ring having a plurality of feet is disposed with its feet resting on the tray-like receptacle. The ring is located above the upper surface of the pizza pie and specifically over the outer, sauce-free ring of dough. The curvature of the susceptor concentrates heat onto both the surface free ring on the upper surface as on well as on the peripheral edge of the dough so that the dough baked in the region of concentrated heat is cooked to a crisp, browned crust. The feet position the ring slightly above and out of direct physical contact with the dough so that the heat is not directed into the dough by conduction. Since the dough typically has an undulating surface, the ring would not be in even contact with the entire surface of the dough. The result would be uneven browning. In some instances, the heat from the ring could actually burn the dough if it were applied for too long a period of time. Therefore, by slightly separating the ring from the dough, even browning of the dough can be achieved. Further, the feet can be hingedly attached to the ring along a score line. Then, when the pizza pie is to be baked, they can be bent into position.

Also, in accordance with the invention, a sixth embodiment of the invention relates to a frozen pizza pie packaged on a substantially circular, tray-like receptacle incorporation a rigid microwave susceptor sheet. An open, dome-like susceptor ring is supported on the upper surface of the susceptor sheet. The ring is constructed of molded plastic and fixed so that it is slightly spaced from the pizza pie. The dome-like ring has an inner concave surface overlying the circular ring on the upper surface of the dough which is free of sauce as well as the outer circumferential edge of the dough. Thus, the dome-like ring can concentrate the heat on these portions of the pizza pie so that the dough in these areas are cooked into a browned, crisp crust.

The dome-like ring is constructed of a molded plastic and the susceptor is preferably constructed by vapor depositing an appropriate metallized layer on the inner surface thereof. An advantage of this design is that the ring can be reused by the consumer, especially when reheating the pizza. When the pizza pie is packaged it is placed between the molded dome-like ring and a susceptor sheet. Then, the ring can be covered with a protective sheet of plastic. Prior to cooking, this protective sheet is preferably removed to prevent condensation of the vapor formed while heating the sauce from collecting on the pie and making it soggy.

In accordance with the invention, a seventh embodiment of the invention relates to a frozen pizza pie package on a substantially circular, tray-like receptacle incorporating a rigid microwave susceptor sheet. A closed dome-like susceptor ring is supported on the upper surface of the susceptor sheet. The closed ring is constructed of molded plastic and sized so that it is slightly spaced from the pizza pie for the reasons discussed before regarding the sixth embodiment. The dome-like ring has an inner concave surface overlying the circular, sauce-free ring on the upper surface of the dough as well as the outer circumferential edge of the dough. Thus, the dome-like ring can concentrate the heat on these portions of the pizza pie so that the dough is cooked into a brown, crisp crust. Since the dome is closed, vapor from the cooking can condense and collect causing the pizza pie to be soggy. To overcome this problem, vent holes are provided in the dome to allow the vapor to escape. Preferably, the vent holes are formed above the sauce so that the likelihood of any condensation collecting on the sauce-free portion of dough will be minimized. A significant advantage to the closed dome construction is that the pizza pie is protected within the box it is packaged.

The primary objective of the present invention is the provision of an inexpensive, disposable appliance or utensil for transporting and reconstituting a pizza pie, which appliance, in combination with the pizza pie itself, controls the cooking of the dough into a crisp crust, and in particular the outer edges of the pie, so that the pizza pie can be reconstituted in a microwave oven while obtaining results generally associated with a standard convection oven.

Another object of the present invention is the provision of an appliance or a utensil, as defined above, which appliance or utensil allows reconstitution of a pizza pie or similar crusted product in a microwave oven while the the progress of the cooking or baking procedure is monitored.

Still a further object of the present invention is the provision of an appliance or utensil, as defined above, which appliance or utensil does not require reconstitution of the pizza pie or similar food product in a carton or enclosure that is resistant to microwave exposure.

Still a further object of the present invention is the provision of a combination of a pizza pie and its cooking appliance or utensil, which combination employs an inexpensive, readily available material while performing a heretofore unobtained cooking process for pizza pies and related products.

By using the present invention to obtain the objective mentioned above and as described with respect to the prior art, the dough of a pizza pie is cooked into a browned, crispy crust. In particular, the dough forming the edges of the pizza pie, which are free of sauce are browned into a high quality, crispy crust quickly and efficiently when subjected to microwave energy. Specifically, the microwave energy is directed through a first susceptor layer directly adjacent the bottom surface of the pizza pie and a second susceptor layer adjacent the peripheral edge and top surface of the dough. The susceptor layer increases in temperature when it is exposed to microwave energy. This causes conductivity and/or convection of the heat directly to the crust upon which the susceptor sheet is resting against or placed closely adjacent thereto. Consequently, the dough is baked into a brown, crisp crust by the absorbed energy. The spacing between the susceptor sheet and the dough is determined by dependent tabs projecting from the edge of the sheet. The spacing is for the purpose of modulating and reducing the heat directed into the dough so that it does not burn but is perceptibly browned and crisped during the time required for the sauce to reach the serving temperature.

It is a further object of the present invention to provide a susceptor ring which is inexpensive and disposable.

These and other objects of the present invention are obtained by the preferred embodiment and certain modifications thereof disclosed in conjunction with the various drawings.

BRIEF DESCRIPTION OF THE DRAWINGS

FIG. 8 is a modification of the susceptor illustrated in FIGS. 6, 7 and 7A wherein tab feet are provided;

FIG. 9 is a cross-sectional view taken generally along line 9—9 of FIG. 8;

FIG. 10 is a pictorial view of a modification of the preferred embodiment wherein a self-sustaining susceptor has a plurality of support legs to support the susceptor above a pizza pie;

FIG. 11 is a cross-sectional view taken generally along line 11—11 of FIG. 10 and showing a pizza pie in phantom;

FIG. 12 is a cross-sectional view of a pizza pie partially enclosed in a modification of the susceptor of the preferred embodiment wherein the susceptor includes a dome-like cover with a central opening in combination with a susceptor support base;

DISCLOSURE

Figure 1:
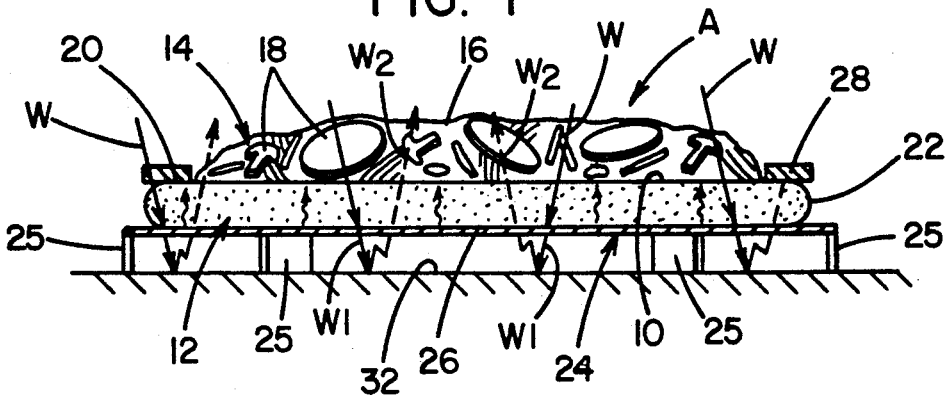
FIG. 1 is a cross sectional view showing a two element appliance for microwave reconstitution of frozen pizza pies.

Referring now to the drawings wherein the showings are for the purpose of illustrating the preferred embodiments of the invention only, and not for the purpose of limiting same, FIG. 1 illustrates a flat, frozen entree A, such as a pizza pie. The pizza is formed by placing on the upper surface 10 of a dough layer 12 a topping layer 14 formed from sauce 16 and miscellaneous food items 18. A ring-like section 20 of the upper surface 10 extending inward from the outer peripheral edge 22 of dough layer 12 is substantially free of sauce 16.

In the past, when a frozen pizza A was cooked in a microwave oven, the dough is not browned nor crisped. In fact, it had a tendency to become soggy from the moisture associated with the sauce. To partially overcome this problem, the prior art has taught the use of a first component, a rigid, microwave susceptor sheet 24 on which the pizza pie is placed and cooked. Preferably a plurality of foldable support tabs 25 project downward from the edge of the sheet 24. In the assembled position, as shown in FIG. 1 the tabs 25 locate the pizza away from the bottom surface 32 of the microwave oven and enable more microwave energy to pass through the susceptor to hasten the cooking of pizza A. The susceptor sheet cooks and browns the bottom surface 26 of dough 12 and thereby alleviates certain problems associated with microwave cooking of frozen pizza; however, the ring-like section 20 of the upper surface 10 and the peripheral edge 22 are not crisped and browned into a high quality crust. Therefore, the prior art did not enable a frozen pizza to be cooked with a microwave oven to an end result which favorably compared with a conventional convection oven.

The present invention, as illustrated in FIG. 1, provides a second component, a microwave susceptor ring 28 which can be constructed of the same material as susceptor 24. The second component, a self-sustaining, generally rigid microwave susceptor ring 28 has a shape substantially matching the preselected size of the ring like section 20, free of sauce on the upper surface 10 of the dough 12. The susceptor ring 28 is directly supported on the upper surface of the sauce-free ring of dough. The first and second components 24 and 28 are in heat conduction relationship with the dough whereby microwave heating of the first and second components cooks the dough placed therebetween into a browned, crisp curst by conduction heating to a temperature of over about 400° F. while the sauce is primarily heated by microwave energy, indicated by arrows W, passing through the dough and directly from a microwave oven having a bottom surface 32.

Figure 4:
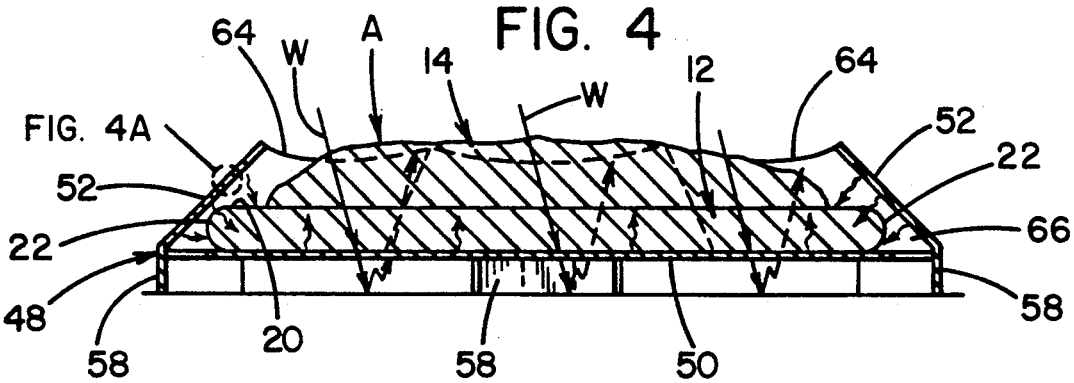
FIG. 4 is a cross-sectional view taken generally along line 4—4 of FIG. 3.
Figure 4A:
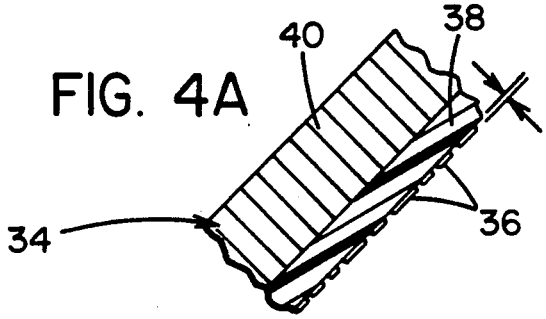
FIG. 4A is an enlarged, cross-sectional view of a section in FIG. 4 illustrating features of a susceptor of the present invention.

Both of the susceptors are disposable and formed from a microwave susceptor sheet stock 34, as illustrated in FIG. 4A, of the type disclosed in Seiferth U.S. Pat. No. 4,641,005. The susceptor sheet includes a generally continuous, microwave interactive material 36 formed by vacuum depositing a thin layer of aluminum or similar metal onto a smooth plastic support film 38 which is, in turn, adhered to a flat, generally rigid paperboard 40 forming the support layer for microwave susceptor sheet 34. By changing the surface resistivity of microwave interactive material 36 through changing the thickness of this layer, the amount of heating caused at the layer of interactive material 36 can be modulated. In accordance with the preferred embodiment of the invention, the interactive material is of the type having a surface resistivity of between 13–16 ohms/inch and is constructed upon a 16 point paperboard which is a somewhat standard weight for the paperboard and is rigid as a standard poster stock. Such microwave susceptor sheet stock material, but with a higher resistivity, is well known in the art and is widely used for microwave heating of various food products. The selection of a low surface resistivity on a firm or generally rigid 16 point paperboard for an encircling, self-supporting ring 28 is believed to be novel. This combination of strength and high heating by low resistivity is a further advantage of the preferred embodiment of the present invention.

Referring now more particularly to susceptor sheet 24 upon which the pizza dough is supported, its shape corresponds to the shape of the pizza pie A. That is, in the instance where the pizza pie has a substantially circular shape, the sheet 24 is also substantially circular. Whereas, when the pizza is of a rectangular or square shape, the sheet 24 is correspondingly rectangular or square. Preferably, the sheet is slightly larger than the pizza pie so that the dough does not project over the outer peripheral edge of the sheets whereby it will not be in direct heating contact with the susceptor. To assure that microwave energy enters through the heat susceptor layer, the sheet 24 is spaced from the bottom surface 32 of the microwave oven during the heating process. The spacing can be maintained by a plurality of foldable tabs 25 which are folded into a generally flat condition when the sheet is shipped and bended to downwardly depending positions as shown in FIG. 1 when the sheet is manually formed into its heating or operative configuration. These foldable tabs 25 are provided with no microwave interactive metallization. They are merely self-sustaining paperboards.

Referring now to FIG. 1, the operative characteristics of the preferred embodiment of the present invention is illustrated graphically and in a general manner so that the features can be appreciated even though such appreciation would be well known to persons skilled in the art. Certain specific operating characteristics do form aspects of the present invention. For instance, one aspect of the invention is to convert all of the microwave energy passing into the sheet 24 from the bottom portion 32 of the oven into heat for convection into the lower layer of dough 12. As further shown in FIG. 1, microwave energy, indicated as rays W penetrates heat susceptor 24 and the susceptor ring 28. During this penetration rays W give up a certain amount of energy to heat the interactive susceptor material. The susceptors 24 and 28 then direct heat into the dough 12. A substantial amount of the microwaves from the microwave oven (not shown), enter the oven chamber for the purpose of heating the upper portion of the pizza by dielectric heating. The microwaves heat the topping which is lossy material. Combined microwave absorption together with slight convention and conduction of heat from the dough 12 efficiently heats the topping at a lower temperature level than needed to bake the dough and brown the outer surface, especially in the area of the ring-like section 20. In accordance with the invention, when rays W first pass through the heat 24 a substantial amount of their energy is removed. The amount of absorption is controlled by the amount of metal in the susceptor layer which is expressed as surface resistivity of interactive material 36. This energy absorption causes a weaker microwave energy illustrated schematically as rays W1 as reflecting off of the bottom surface 32 of the oven and again through the susceptor sheet 24 where they again interact with the interactive layer and convert even more of the microwave energy in the original ray W into heat. Only a minor portion, if any of the original microwave radiations, illustrated as rays W then pass through the dough and into the topping layer 14. This negligible amount is shown as rays $W_2$, which may be substantially zero. Thus, when the dough 12 is heated by microwaveable interactive layer 36, there is a high heat concentration into the dough 12.

As discussed herein before, a specific advantage of the present invention is the ability to cook the ring-like, sauce-free section 20 into a brown, crisp crust which was heretofore unavailable through microwave cooking or reconstitution of frozen pizza pies. By the direct application of the ring-like susceptor 28 on the ring-like section 20 of the dough 12, the sauce-free ring of dough is browned by the concentration of heat generated between the ring-shaped susceptor 28 and the sheet susceptor 24. When the microwaves pass through the ring susceptor 28, a large portion of the energy is absorbed by interaction with the microwave interactive layer on the susceptor and then converted into heat. The remainder of the waves continue downward and pass through the susceptor sheet 24 where the majority of the remaining wave energy is converted into heat by interaction with the interactive layer. Any of the remaining energy left in the wave will be converted into heat when the wave reflects off of the bottom surface 32 of the microwave oven and passes again through the susceptor sheet 24. Thus, the majority of the incoming microwave energy in the vicinity of the sauce-free, outer section of the dough is converted into heat and directly conveyed into the upper surface of the dough under the susceptor 28. At the same time, the remainder of the dough and sauce is properly cooked by the heat generated from the combination of the susceptors and direct microwave energy.

Figure 2:
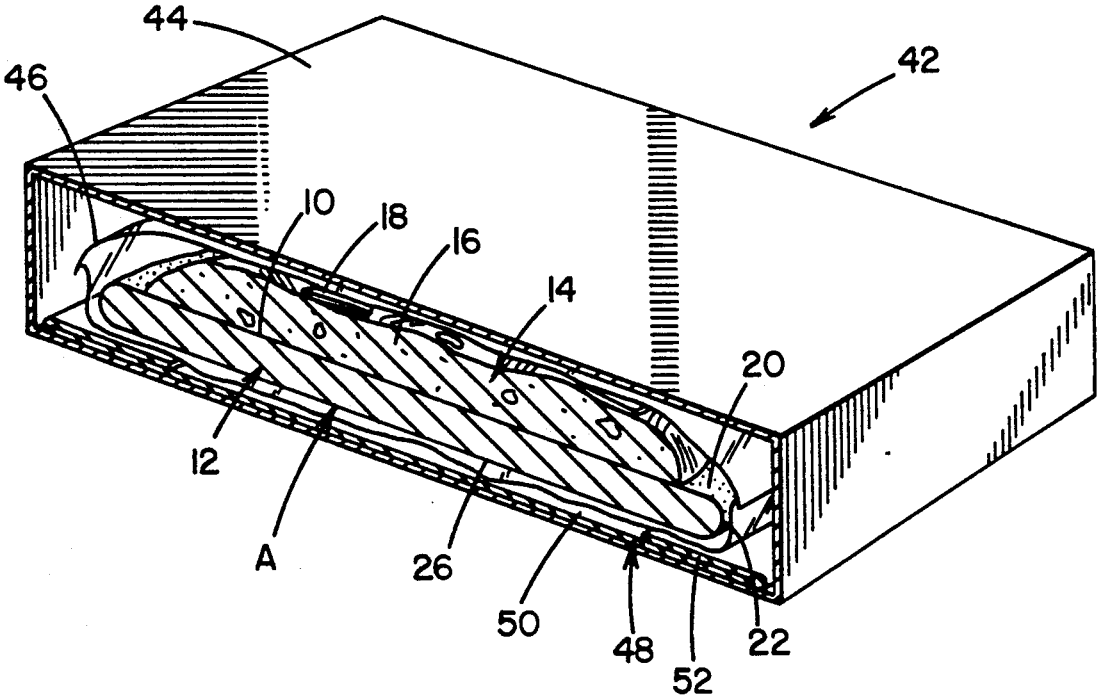
FIG. 2 is a partially cross-sectioned pictorial view of a packaged frozen pizza containing a self-sustaining, generally rigid susceptor in the collapsed, shipping configuration.
Figure 5:
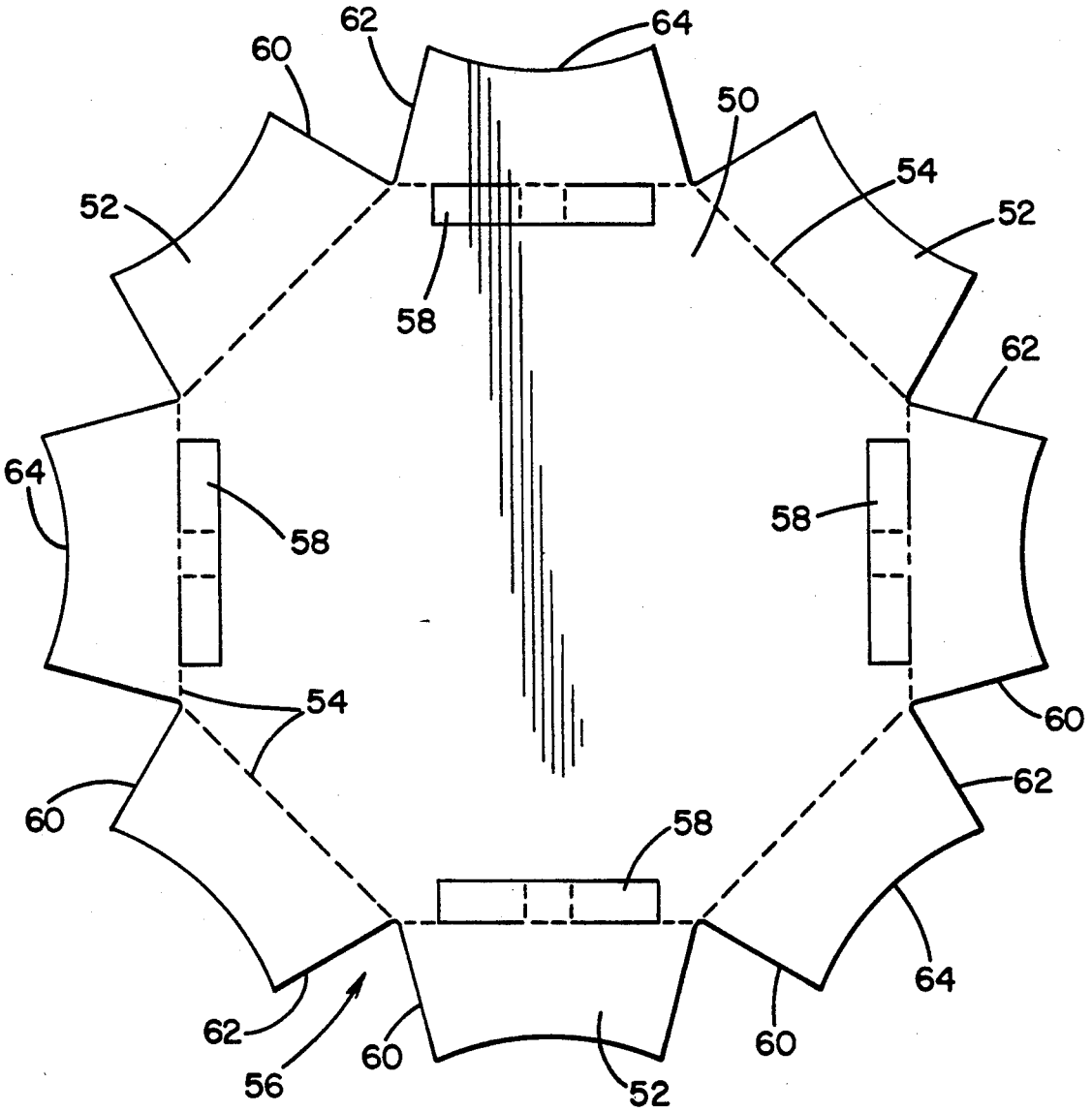
FIG. 5 is a construction layout of the sheet stock blank as it is cut and scored for assembly into the shape illustrated in FIGS. 2–4.

Although not specifically illustrated, the frozen entree A and the susceptors 24 and 28 as well as the other embodiments set forth herein are packaged as generally illustrated in FIG. 2. A package 42 is formed of paperboard and includes an outer shipping carton 44 of the type which is not microwave compatible and is selected for shipment purposes only. Food article A is wrapped in an air impermeable, plastic wrapper 46 which may be evacuated or filled with an inert gas. Article A is frozen and shipped in carton 44 for display in the freezer section of a retail outlet. Within carton 44 there is provided a disposable heating or reconstitution receptacle in the preferred form of susceptor, such as formed from a microwave, susceptor the sheet stock having a blank, as illustrated in FIG. 5. The sheet stock can be in a collapsed condition with only the tabs having to be bent into position. Then the pizza pie need only be removed from plastic wrapper 46 and appropriately placed in the microwave susceptor(s). After cooking a predetermined time, the sauce is heated and the dough cooked until it is browned and crispy.

Figure 3:
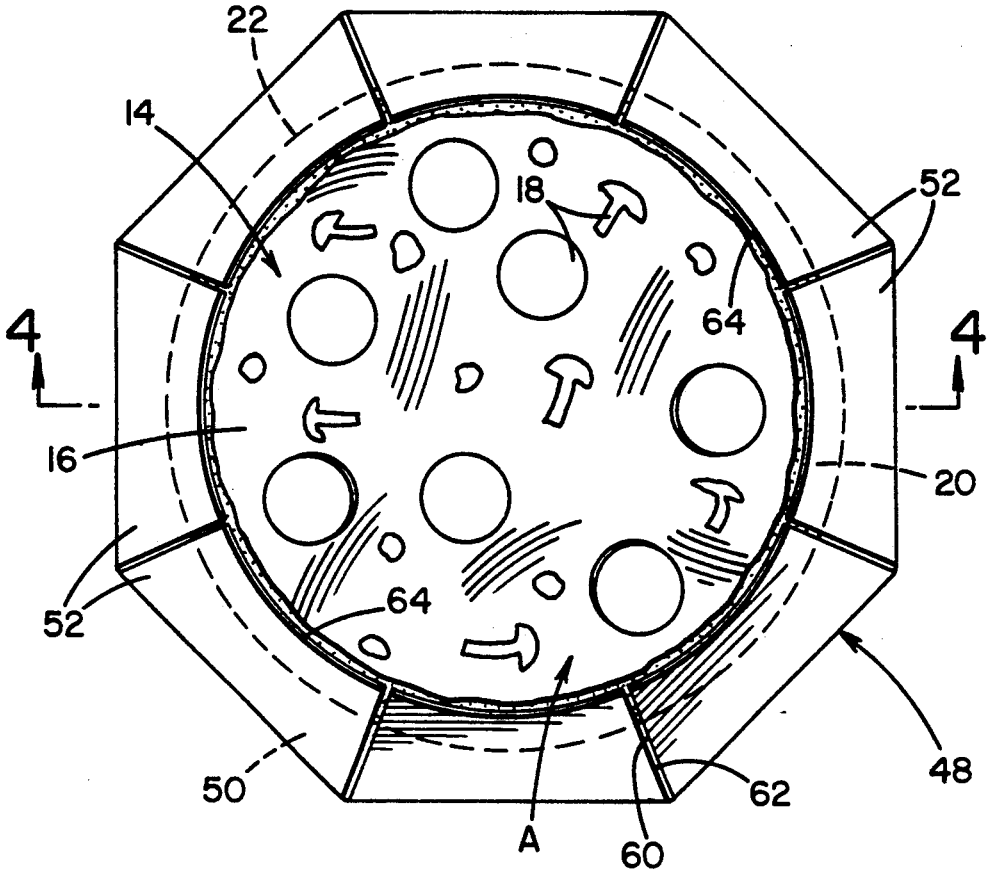
FIG. 3 is a plan view of a pizza inserted into a susceptor in the assembled, freestanding, heating configuration.

A modification of the preferred embodiment is illustrated in FIGS. 3–5 wherein a freestanding receptacle of the present invention is in the structural form of an octagonal susceptor base 50 having upstanding susceptor corner heat tabs 52 interconnected to the eight edges of the susceptor base along cut lines or serrated seams 54. By incorporating these seams, the susceptor sheet, paperboard blank 56, illustrated in FIG. 5, can be folded in a collapsed condition, as shown in FIG. 2, or can be manually expanded into the operative heating configuration, as shown in FIGS. 3 and 4. The susceptor base also includes downwardly depending legs 58, cut from the microwave interactive material sheet 56, which are in a generally flat condition when the susceptor sheet 56 is collapsed, as shown in FIG. 5, and folded to downwardly depending positions, as shown in FIG. 4, which illustrates the susceptor sheet is manually formed into its heating or operative configuration.

Referring to FIGS. 3 and 4, the susceptor base 50 is illustrated in the operational condition with the legs 58 folded downward to position the susceptor base away from the bottom surface of the microwave oven. The heat tabs 52 are also positioned at an acute angle, such as between 30° and 60° and preferably about 45° to the base 50. The tabs are shaped so that the edges 60 and 62 of adjacent tabs are next to each other and the curved outer edges 64 form a substantially circular edge which approximately overlies the ring-like section 20 of the dough near its intersection with the topping layer 14.

A unique aspect of the susceptor 48, as illustrated in FIGS. 3 and 4, is a heat concentration chamber 66 formed between the heat tabs 52 and the base 50 when the tabs are in their operative position. As microwaves pass through the tabs 52, their energy is absorbed to heat the tabs which in turn radiate heat that is concentrated under the tabs for cooking the outer, sauce-free ring. Not only does the top surface of the dough bake to a browned, crisp crust properly cooked, but the outer peripheral edge 22 is similarly baked. Any unabsorbed microwaves that then pass through base 50 are absorbed to generate additional heat in the heat concentration chamber 66 to quickly and efficiently cook the ring-like section 20 of dough 12 until it is brown and crisp. The circular opening defined by the edges 64 of the heating tabs 52 enables the microwaves to directly pass into the sauce 14 and the dough on which it is spread. The energy microwaves W which pass directly through the sauce and then into the base 50 are absorbed to heat the sauce, the dough and the susceptor itself. The susceptor then radiates heat which is directed upward into the dough to preferably cook the dough until it is crisp.

While the embodiment illustrated in FIGS. 3–5 is primarily for a circular pizza, it is within the terms of the present invention to form the susceptor base as a square or rectangular shape or to change the number of heat tabs 52 to, for example 5, 6, 10 or 12.

Figure 6:
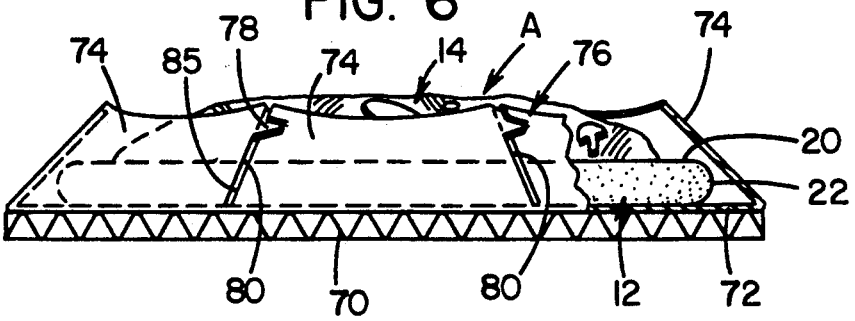
FIG. 6 is a partially cross-sectional view of a modification of the invention illustrated in FIGS. 3–5 illustrating locking tab structure and corrugated paperboard stock bonded to the base of sheet stock blank.
Figure 7:
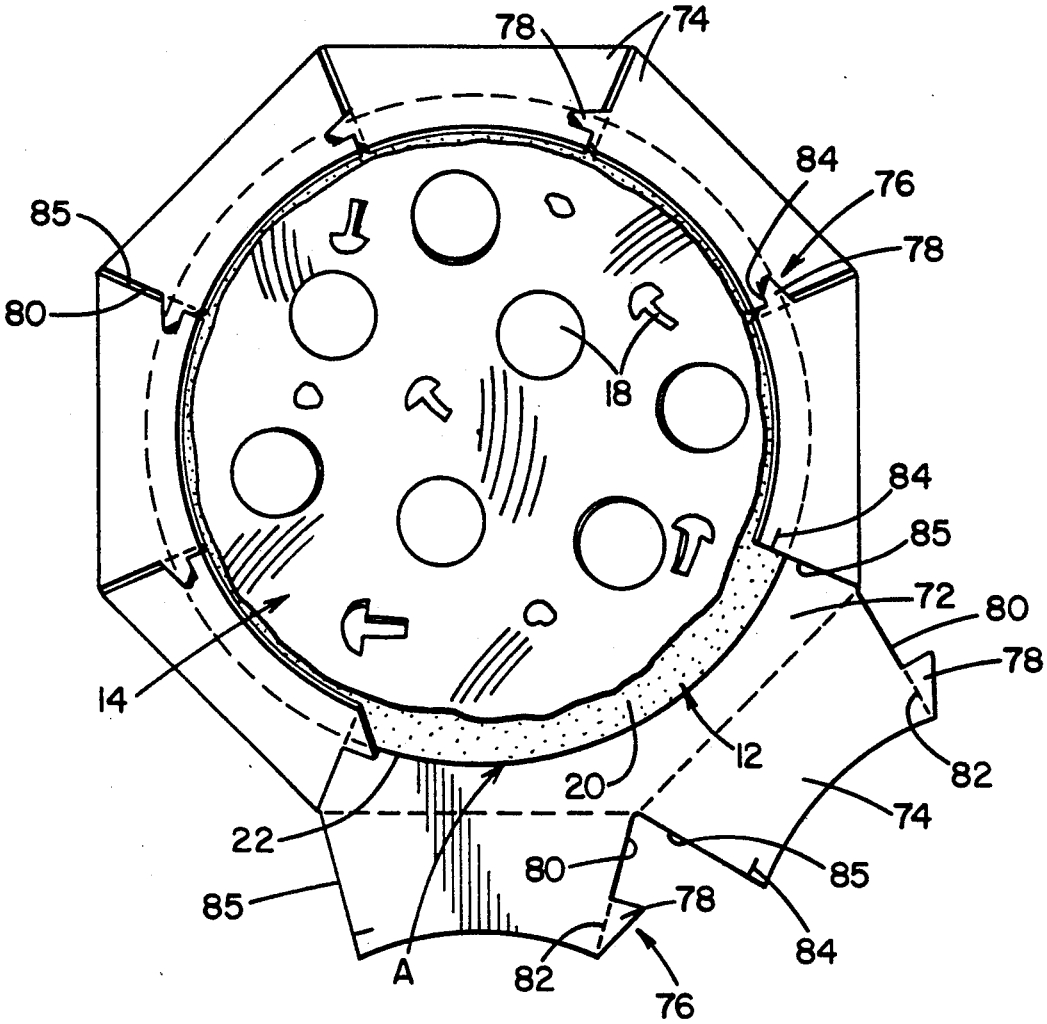
FIG. 7 is a plan view of a pizza pie in a partially assembled, self-sustaining susceptor of the type illustrated in FIG. 6.
Figure 7A:
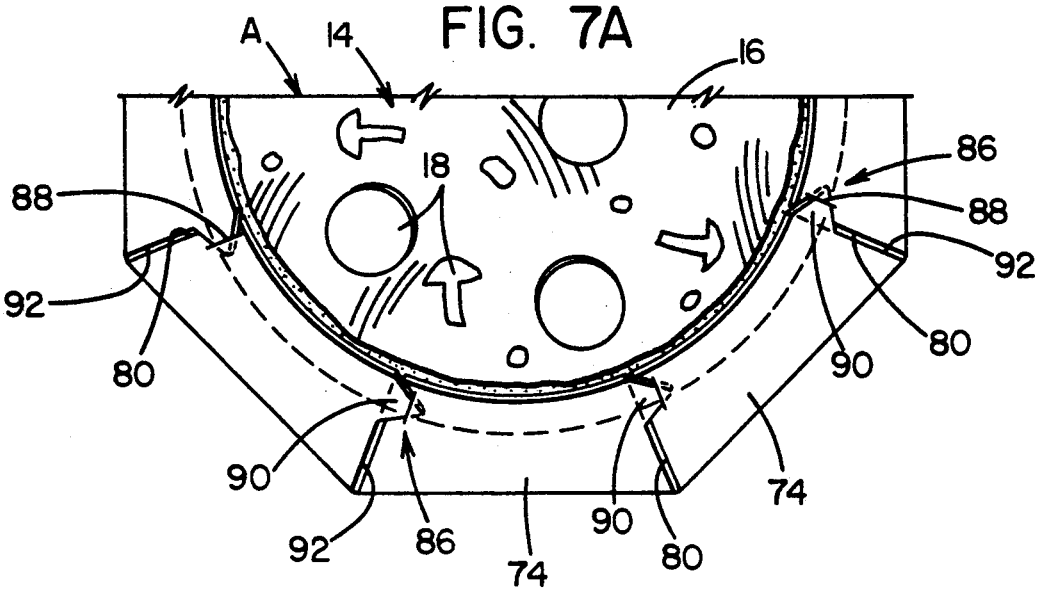
FIG. 7A is an enlarged, partial plan view of a modification of the invention illustrating a further locking tab structure of FIG. 7.

A modification of the embodiment illustrated in FIGS. 3–5 is illustrated in FIGS. 6–7A. A corrugated paper layer 70 is bonded to the susceptor base 72 to replace the legs 58. The corrugated paper layer supports the susceptor base 72 away from the bottom wall of a microwave oven. Although the corrugated layer is illustrated as being solely attached to the susceptor base 72, it is also within the terms of the invention to provide it on the heat tabs 74 so that the susceptor sheet and corrugated paper can be bonded together prior to the paperboard blank, similar to the one illustrated in FIG. 6, is cut out. The corrugated paper can be incorporated in any of the susceptor devices disclosed herein.

Another feature of the device illustrated in FIGS. 6 and 7 is a locking device 76 for locking adjacent heating tabs 74 to each other after they are folded into their acute angle, operating position. The locking device includes a closing tab 78 projecting from a side 80 of each of the heating tabs 74. The closing tab folds about a perforated fold line 82 and is inserted into a slit 84 which extends inwardly and substantially perpendicular to edge 85 of tabs 74. When the closing tabs 78 are inserted into slit 84, the heat tabs 74 are secured in their acute angle operative. In the embodiment illustrated in FIG. 7, the tab 78 can be easily inserted into the slit 84 for each of the heating tabs 74.

Referring to FIG. 7A, a modified locking device 86 is illustrated. The locking device 86 includes a slit 88 which is formed in the heating tabs 74 and extends adjacent to and parallel with one edge 80 of the tabs. The closing tabs 90 projecting outward from edges 92 can be shaped substantially as equilateral triangles. However, the specific shape of the closing tabs is not critical to the present invention. As seen in FIG. 7A, the insertions of tabs 90 into slit 88 secures the heating tabs 74 in their operable position.

Turning to FIGS. 8 and 9, there is illustrated a modification of the heating tabs of FIGS. 3–7A which form a triangularly shaped heating chamber 66. According to the modification, heating chamber 94 of the susceptor device 95 has a substantially rectangular shape.

Heating tabs 96 are foldably attached to the susceptor base 97 which is substantially identical to susceptor base 50 along fold lines 98. The tabs 96 also include a second fold line 100 dividing the tabs into upper and lower sections 102 and 104, respectively. The lower section 104 of the tab is manually bent along fold line 98 preferably at an angle of about 90° to the base 97. The upper section 102 of the tab is bent about fold line 100 at an angle of about 90° so that the upper section 102 overlies the base 97 to lower section 104. The tabs can be locked into place by insertion of closing tabs 78 into slits 84, as discussed hereinbefore.

During microwave cooking of pizza pies using the susceptor device 95 illustrated in FIGS. 8 and 9, the spacing between the upper and lower sections 102 and 104 of the heating tabs 96 and the sauce-free, ring-like section 20 and the outer peripheral edge 22 of the pizza is substantially the same. Therefore, during the cooking procedure, the dough in the heating chamber 94 is baked to a relatively even, crisp consistency. Since the upper and lower sections 102 and 104 of the heating tab are spaced from the dough, there is a reduced chance of overbaking the dough in the heating chamber.

A modification of the embodiment of the invention illustrated in FIG. 1 is illustrated in FIGS. 10 and 11. A self-sustaining, generally rigid, microwave susceptor ring 110 is constructed of a ring member 112 and plurality of legs 114. The ring 110 can be constructed of a generally rigid paperboard susceptor sheet which is substantially the same as material 34 described before. This is particularly advantageous if the ring is to be disposable. However, if desired, the ring can be constructed of a plastic with an interactive layer 116 vacuum deposited thereon. The width of the ring 112 is selected to extend from the edge of the topping layer 14 to slightly beyond the outer peripheral edge of the dough 12.

The legs 114 are folded downward to position the ring 112 slightly above the upper surface 10 of the dough layer. As illustrated in FIG. 1, the pizza pie A is preferably placed on a susceptor sheet 24. The legs 114 preferably rest on the upper surface of the susceptor sheet 24. The advantage of this embodiment is that it bakes the dough in the sauce-free, ring-like section 20 to a crisp condition. However, since the ring 112 is not typically positioned to be free of physical contact with the dough, it does not have a tendency to actually brown the surface of the dough. If, on the other hand, the browning effect is desired, the legs 114 (in the case of the paperboard structure) can be bent at an appropriate angle so that the underside of the ring rests directly on the surface of the dough.

Figure 13:
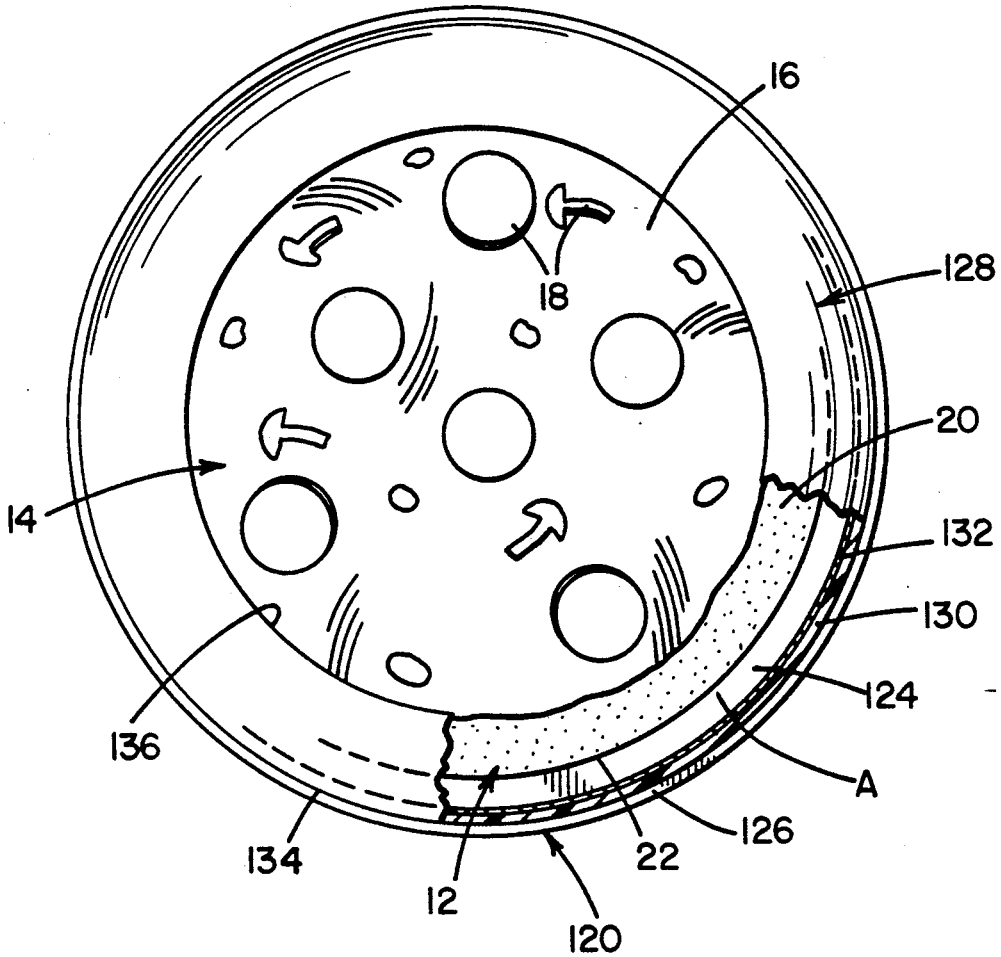
FIG. 13 is a plan view, with a cut away section exposing the susceptor construction, taken generally along line 13—13 of FIG. 12.

Referring to FIGS. 12 and 13, another embodiment of the invention is illustrated. A relatively, rigid, circular shaped, tray-like receptacle 120 is provided for supporting the layer of dough forming the pizza pie. The receptacle is preferably constructed of a plastic layer 122 and has an interactive layer 124 deposited thereon, as discussed hereinbefore. Around the circumference of the receptacle 120 is a stepped footing 126 which functions to raise the receptacle above the bottom wall of the microwave to enhance the cooking of the pizza. In addition, the footing serves to position and secure an open susceptor dome 128.

Dome 128 has a concave shaped, circular wall constructed of a plastic layer 130 and a susceptor layer 132 on the inner surface. The outer end 134 of the dome is adapted to be seated on the footing 126 of the receptacle 120. An inner edge surface 136 defines an opening through the dome which enables microwaves to directly impinge on the topping layer 14. The inner edge surface 136 is preferably positioned above the intersection of the topping layer 14 and the ring-like section 20 of the dough. Thus, the concave wall is positioned about the sauce-free, ring section 20 of the dough and cooks it to a crisp, as discussed with regard to the other embodiments previously discussed. Since the base receptacle 120 and the dome 128 are constructed of plastic, they are reusable. Although the base 120 and the dome 128 are described as being circular, it is within he terms of the invention to construct them with any desired shape, such as oval or rectangular.

Figure 14:
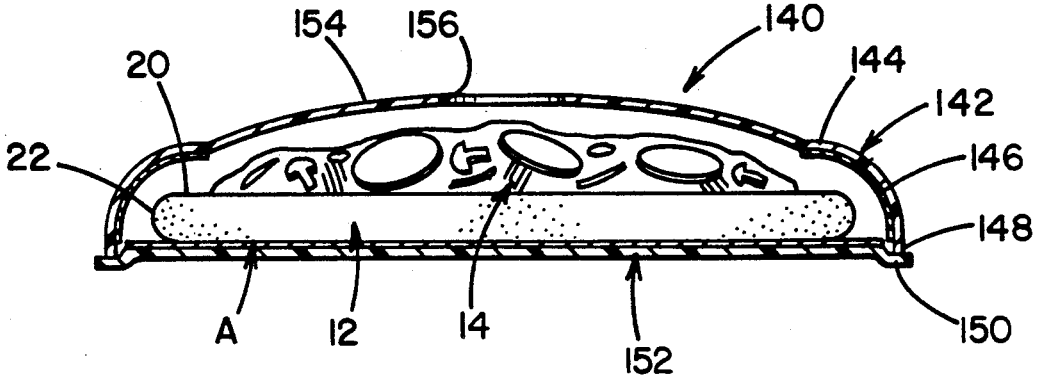
FIG. 14 is a cross-sectional view of a pizza pie enclosed in a modification of the susceptor illustrated in FIGS. 12 and 13 wherein the dome-like cover includes a small central opening to vent vapor formed while the pizza is cooked.

Referring to FIG. 14 there is illustrated a modification of the embodiment illustrated in FIGS. 12 and 13. A dome 140 has a circular, concave shaped wall 142 constructed of a plastic layer 144 and a susceptor layer 146 forming the inner surface. The outer end 148 of the dome is adapted to be seated on the footing 150 of the receptacle 152 which is substantially the same as receptacle 120 illustrated in FIGS. 12 and 13. The dome of FIG. 14 includes a curved top wall 154 which covers the topping layer 14. A vent hole 156 is provided to vent any vapor found during the cooking of the pizza pie. The top wall 154 does not have a susceptor layer and is essentially invisible to the microwaves. The advantage of this embodiment is that the vent hole can be sealed with tape and the pizza can be packaged within the dome in a ready to cook condition. Only the seal from the vent hole need be removed and the assembly including the susceptors and the pizza can be inserted into the microwave oven for baking.

The invention has been described with reference to the preferred embodiments and it is apparent that many modifications can be incorporated into the designs and configurations of the device for reconstituting frozen pizza disclosed herein without departing from the spirit or essence of the invention. It is intended to include all such modifications and alterations in so far as they come within the scope of the present invention.

Having thus described the invention, it is claimed:

1. An improved appliance for reconstituting a frozen pizza pie in a microwave oven, said pizza pie including a layer of dough having an upper surface covered by a precooked topping layer, except for an outer sauce-free ring of dough extending inwardly from the outer peripheral edge of the layer of dough, said improvement comprising:

a) a first component shaped as a tray-like receptacle formed of a generally rigid microwave susceptor sheet for supporting the layer of dough; and b) a second component formed into a self-sustaining, generally rigid microwave susceptor ring having a shape substantially matching the sauce-free ring on the upper surface of the dough and being adapted to be directly exposed to the sauce-free ring of dough, said first and second components being in contact with said pizza dough forming a heat conduction relationship with said dough whereby microwave heating of said first and second components directly bakes the bottom surface of the dough and the sauce-free ring of dough on the top surface into a browned, crisp crust while said topping layer is heated by microwave energy and by heat conduction from said dough.

2. The appliance as defined in claim 1 wherein said susceptor sheet and said susceptor ring are each constructed of a thin, metallized layer on a plastic film laminated to a paperboard.

3. The appliance as defined in claim 1 wherein said susceptor sheet further includes a corrugated paper layer bonded to the paperboard positioning the tray-like receptacle from a base surface of said microwave oven.

4. The appliance as defined in claim 1 wherein said susceptor sheet includes a plurality of foldable support tabs projecting downward from the edge of the susceptor sheet to position the susceptor sheet away from a base surface of said microwave oven.

5. The appliance as defined in claim 2 wherein the surface resistivity of said metallized layer being between 13–16 ohms/inch and said paperboard has a 16 point thickness.

6. An improved appliance for reconstituting a frozen pizza pie in a microwave oven, said pizza pie including a layer of dough having an upper surface covered by a precooked topping layer, except for an outer, sauce-free ring of dough extending inwardly from the outer peripheral edge of the layer of dough, said improvement comprising:

a polyhedron shaped, tray-like receptacle including a generally rigid microwave susceptor sheet for supporting said layer of dough, said receptacle further including a plurality of heat tab means each hinged by a first edge of a fold line, said tab means being folded at said first edge to an acute angle so as to overlie said sheet thereby forming a heat concentration chamber to receive said sauce-free ring of dough, said receptacle being in heat conduction relationship with said dough whereby microwave heating of said susceptor sheet bakes the bottom surface of the dough into a browned, crisp crust, said tab means at least overlying said sauce-free ring of dough and in heat convection relationship with said outer peripheral edge of the dough and said sauce-free ring of dough whereby microwave heating of said tab means primarily and essentially uniformly bakes the outer dough surfaces by convection into a browned, crisp crust, said topping layer primarily heated from heat convection from said baked dough and by microwave energy passing through said topping layer.

7. The appliance as defined in claim 6 wherein each of the heat tab means has a second edge oppositely disposed from said first edge, the second edges of said tab means forming a substantially continuous edge which approximately overlies the junction between the sauce-free ring and the topping layer when the tab means are folded into their operative position for baking the pizza.

8. The appliance as defined in claim 7 wherein the tray-like receptacle includes a corrugated paper layer for supporting the tray-like receptacle away from an inner wall of said microwave oven in which it is disposed.

9. The appliance as defined in claim 8 wherein the polyhedron shaped fold line is perforated whereby each of said heat tab means can be folded to an operative, acute angle position from a flat, storage position in the plane of the susceptor sheet.

10. The appliance as defined in claim 9 wherein said heat tab means has an operative angle position of about 30° to 60°.

11. The appliance as defined in claim 10 wherein said heat tab means has an operative angle of about 45°.

12. The appliance as defined in claim 9 further including lock means for locking adjacent tab means to each other when they are folded into their operative positions.

13. The appliance as defined in claim 6 wherein said receptacle includes a thin, metallized layer on a plastic film laminated to a paperboard.

14. The appliance as defined in claim 13 wherein the tray-like receptacle includes a corrugated paper layer for supporting the tray-like receptacle away from the bottom wall of said oven.

15. The appliance as defined in claim 6 wherein said polyhedron, tray-like receptacle is substantially octagonal in shape.

16. The appliance as defined in claim 6 wherein said polyhedron, tray-like receptacle is substantially rectangular in shape.

17. The appliance as defined in claim 13 wherein the surface resistivity of said metallized layer being between 13–16 ohms/inch and said paperboard has a 16 point thickness.

18. An improved appliance for reconstituting a frozen pizza pie in a microwave oven, said pizza pie including a layer of dough having an upper surface covered by a precooked topping layer, except for an outer sauce-free ring of dough extending inwardly from the outer peripheral edge of the layer of said dough, said improvement comprising:

a) a first component shaped as a tray-like receptacle formed of a rigid microwave susceptor sheet for supporting the layer of dough; and b) a second component formed into a self-sustaining, generally rigid microwave susceptor ring having a shape generally matching the sauce-free ring of dough, said susceptor ring supported directly above the sauce-free ring of dough, said first component being in heat conduction with said bottom of said dough and second components being in heat convection relationship with said sauce-free ring of dough whereby microwave heating of said first and second components bakes said dough into a browned, crisp crust and primarily cooks the topping layer by heat convection through said dough; and c) said second component having a plurality of leg flaps foldably attached to an outer edge of said susceptor ring, said leg flaps being folded into an operative position substantially perpendicular to said ring whereby said leg flaps rest on the tray-like receptacle and support said susceptor ring directly above the sauce-free ring of dough.

19. The appliance as defined in claim 18 wherein said receptacle includes a thin, metallized layer on a plastic film laminated to a paperboard.

20. The appliance as defined in claim 19 wherein the surface resistivity of said metallized layer being between 13–16 ohms/inch and said paperboard has a 16 point thickness.

21. An improved appliance for reconstituting the frozen pizza pie in a microwave oven, said pizza pie including a layer of dough having an upper surface covered by a precooked topping layer, except for an outer, sauce-free ring of dough extending inwardly from the outer peripheral of the layer of said dough, said improvement comprising:

a) a first component shaped as a tray-like receptacle formed of a rigid microwave susceptor sheet for supporting the layer of dough; and b) a reusable second component formed into a self-sustaining, generally rigid, dome having a side wall extending downward from the upper section for supporting the dome on said susceptor sheet, a microwave susceptor integrally constructed in said side wall and disposed over the sauce-free ring of dough on the upper surface of said dough whereby microwave heating of said first component bakes the bottom of said dough by heat conduction and microwave heating of said second component bakes the sauce-free ring of dough and outer peripheral edge of the dough by heat convection such that said dough is evenly browned, forms a crisp crust and said topping layer is primarily heated by the dough.

22. The appliance as defined in claim 21 wherein said dome includes an upper central section disposed above the precooked topping layer.

23. The appliance as defined in claim 22 wherein said upper central section to said dome is penetrable by microwaves.

24. The appliance as defined in claim 23 wherein vent means are provided in the dome to release the vapor collected within the dome during the cooking of the pizza pie.

25. The appliance as defined in claim 24 wherein said vent means comprises at least one hole in the central section of said dome.

26. The appliance as defined in claim 25 wherein said dome is of a plastic material and the susceptor ring includes a thin, dome metallized layer on the plastic.

27. The appliance as defined in claim 26, wherein the surface resistivity of said metallized layer being between 13–16 ohms/inch.

28. An appliance as defined in claim 21 wherein said dome is of a plastic material and the susceptor ring includes a thin, dome metallized layer on the plastic.

29. The appliance as defined in claim 28 wherein said side wall is circular and has a concave curved surface facing the pizza pie.

* * * * *